United States Patent [19]

Wright

[11] 4,216,786

[45] Aug. 12, 1980

[54] SMOKING DEVICE

[75] Inventor: Ronnie G. Wright, Shelby, N.C.

[73] Assignee: High Tech, Inc., Boston, Mass.

[21] Appl. No.: 49,022

[22] Filed: Jun. 15, 1979

[51] Int. Cl.[3] ..... A24F 1/26; A24F 3/00

[52] U.S. Cl. ..... 131/180; 131/185; 131/263

[58] Field of Search ..... 131/180, 185, 181, 178, 131/179, 198, 170 R, 263

[56] References Cited

U.S. PATENT DOCUMENTS

| | | | |
|---|---|---|---|
| 937,073 | 10/1909 | Irving | 131/193 |
| 1,578,810 | 3/1926 | Dall | 131/180 |
| 1,938,874 | 12/1933 | Stone | 131/185 |
| 2,549,727 | 4/1951 | Van Toll | 131/185 |
| 2,561,626 | 7/1951 | Hutcheson | 131/175 |
| 3,211,158 | 10/1965 | Shih et al. | 131/173 |
| 4,066,088 | 1/1978 | Ensor | 131/185 |
| 4,080,972 | 3/1978 | Furlow | 131/180 |
| 4,083,374 | 4/1978 | Jacobsen | 131/178 |
| 4,146,042 | 3/1979 | Maiorana | 131/185 |
| 4,151,849 | 5/1979 | Beck | 131/180 |

*Primary Examiner*—Stephen C. Pellegrino
*Attorney, Agent, or Firm*—Geoffrey R. Myers

[57] ABSTRACT

A smoking device is provided which includes a base having compartments for holding tobacco or the like and a lighter. At one end of the base is a rotatable, longitudinally extending and hollow burning chamber having an elongated longitudinal opening in one side thereof and having relatively small orifices in either end. A lighter is positioned in one of the compartments of the base so that its flame when lit, extends adjacent one of the orifices in the burning chamber. The other orifice in the chamber has located proximal thereto, a rotatable smoking stem provided with an orifice which may be aligned with the chamber orifice by appropriate rotation of the smoking stem. Further rotation of the stem disengages its orifice from alignment with the chamber orifice and locates the stem in a storage compartment in the base. The rotatable burning chamber may be rotated about its longitudinal axis so as to align the elongated opening therein with the tobacco compartment for loading the chamber. Further rotation disengages such alignment and locates the burning chamber in its smoking mode. A stop mechanism and designations are provided to indicate to the user which mode the burning chamber is in. A cap is provided for the burning chamber which is so designed that it cannot be opened when the orifice of the smoking stem is aligned with its respective burning chamber orifice.

12 Claims, 6 Drawing Figures

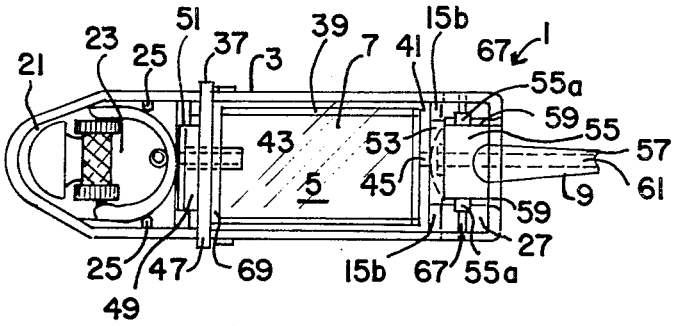
FIG. 1
FIG. 2
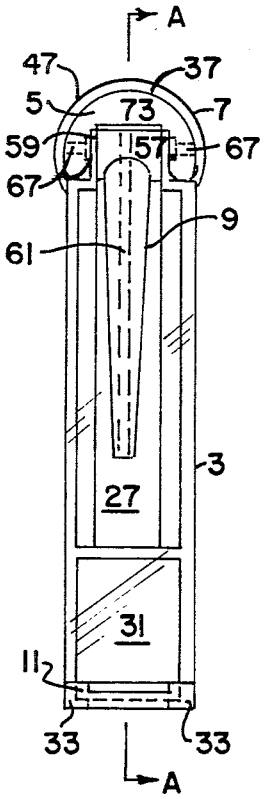
FIG. 3
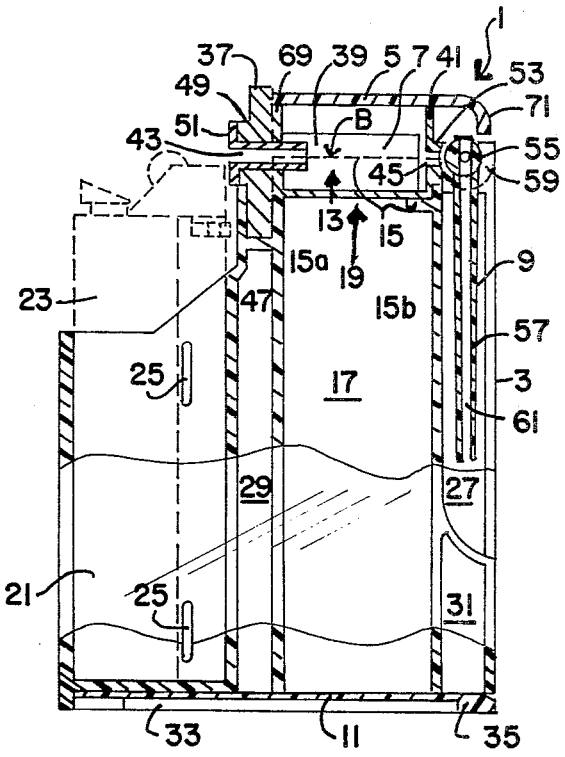

SMOKING DEVICE

This invention relates to smoking devices. More particularly, it relates to smoking devices having various accessory features connected thereto.

Various smoking devices have been designed to include one or more accessory or novelty functions in addition to the mere smoking act. Exemplary of the state of the art in this respect are the following U.S. Pat. Nos.:

937,073
1,578,810
1,938,874
2,549,727
2,561,626
3,211,158
4,066,088
4,080,972
4,083,374

In addition a commercial device exists which is in the nature of a hollowed block of wood containing a tobacco (or other smoking material) chamber in communication with a small rotatable bowl-like burning chamber and having a smoking orifice in communication with the burning chamber. Provision is made for a lighter in the base which, in uncapped fashion, may be used to ignite the smoking material in the burning chamber when exposed, and after rotation thereby, to close the smoking material chamber. A cleaning element exists in a tubular compartment in the wood base.

The subject invention provides unique features on a smoking device heretofore not used or contemplated, thereby to provide a unique, improved smoking device which generally comprises:

a base member having at least three compartments therein, said compartments including a first compartment for rotatably retaining a longitudinal burning chamber, a second compartment for retaining a material to be smoked, said second compartment being in dispensing communication with said first compartment, and a third compartment for retaining therein a means for providing a flame to said burning chamber:

a longitudinally extending, hollow burning chamber comprised of a side wall, a front wall and a rear wall, said side wall having located therein a loading orifice, said front wall having located therein a flame admitting orifice and said rear wall having located therein an exit orifice, said chamber being retained in said first compartment so as to be rotatable thereby to bring said loading orifice into and out of dispensing communication with said second compartment and further so as to locate said flame admittng orifice in proximal alignment with said third compartment;

a smoking stem rotatably attached to said base member, said stem being provided with a smoking orifice so located that upon rotation of said stem, said smoking orifice may be aligned or unaligned with said exit orifice; and means for opening or closing said loading orifice when said loading orifice is out of dispensing communication with said second compartment.

This invention will now be described with respect to certain embodiments thereof as illustrated in the accompanying drawings wherein:

IN THE DRAWINGS

FIG. 1 is a top plan, partial view of an embodiment of this invention.

FIG. 2 is a rear plan view of the embodiment of FIG. 1.

FIG. 3 is a side plan, partially sectionalized and cutaway view of the embodiment of FIG. 1 taken along section line A—A of FIG. 2.

Figure 4:
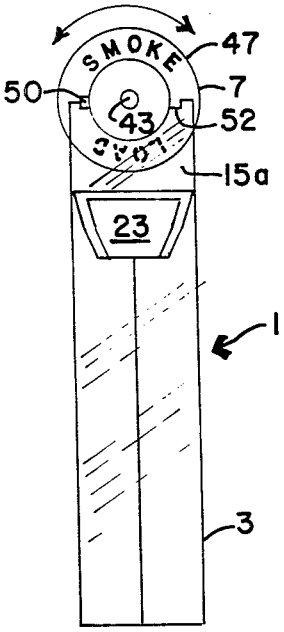
FIG. 4 is a front plan view of the embodiment of FIG. 1.
Figure 5:
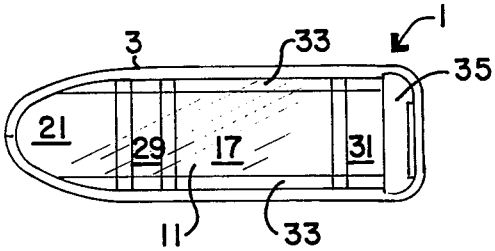
FIG. 5 is a bottom plan view of the embodiment of FIG. 1.

With reference to the drawings, there is illustrated a smoking device 1 comprised of a base member 3, a cap 5, a burning chamber 7, a smoking stem 9, and a removable bottom plate 11. The base member 3 may be made of any convenient material such as transparent, nonflamable plastic.

Base member 3 has located therein a plurality of compartments. Compartmet 13 defined by walls 15 rotatably houses burning chamber 7. Compartment 17 is a storage chamber for the smoking material (not shown). Compartment 17 is an open ended chamber communicating at its upper end with burning chamber 7 via opening 19 in walls 15 and being closed off at the bottom by plate 11. Compartment 21 houses lighter 23 (shown in full lines in FIG. 1, in dotted silhouette in FIG. 3, and omitted in FIG. 4 for convenience). Lighter 23 may be of any convenient type such as the well-known "BIC"cigarette lighter. Compartment 21 is designed so as to securely (but removably) house lighter 23. In the illustrated embodiment retaining flanges 25 help to secure lighter 23 therein as well as to align the flame (not shown) with burning chamber 7 (as described hereinafter). Compartment 27 houses smoking stem 9. Compartment 29 is located between compartments 21 and 17 and may be conveniently used to store "pipe cleaners" for cleaning the device, or the like. Compartment 31 is for storage of any miscellaneous items.

Bottom plate 11 renders compartments 17, 29 and 31 accessible for loading or unloading merely by slidably removing it from its retaining grooves formed by L-shaped legs 33. This is done by grasping handle tab 35.

Burning chamber 7 is cylindrical in shape and is formed by front wall 37, side wall 39 and rear wall 41. Flame orifice 43 extends through front wall 37 and exit orifice 45 extends through rear wall 41, each along the central longitudinal axis of cylindrical burning chamber 7.

Front wall 37 includes a large disc member 47 which is rotatably retained between walls 15*a*. Extending forwardly from disc 47 is another, smaller but concentric disc 49 which rotatably rests in the saddle seat formed in the forwardmost of walls 15*a*. Flame resistant tube 51 extends over the face of disc 49 and through orifice 43. Tube 51 extends well into the chamber 7 which as illustrated is open at the top (in the position shown) by cutting away an elongated section of side wall 39 along substantially the entire length of the wall and hollow chamber formed thereby. In practice, the opening is somewhat less than semicircular, and is large enough to allow for easy loading as described later.

Concentric disc 49 is provided with a small radial protrusion 50 which matches in size with grooves 52 located in the upper surfaces of forwardmost wall 15*a*. When rotated fully counterclockwise, protrusion 50 fits into left hand (FIG. 4) groove 52 and the opening in side wall 39 is uppermost; thus side wall 39 closes off opening 19, which in turn closes compartment 17. When rotated fully clockwise, protrusion 50 fits into right hand groove 52 and the opening in side wall 39 is aligned with opening 19, thereby bringing compartment 17 into dispensing communication with chamber 7. The face of large disc 47 may be conveniently provided with indicia as to which groove 52 when filled by protrusion 50 locates chamber 7 in its loading (right hand) position or smoking (left hand) position. Simple lettering or indicia may be used for this purpose.

Rear wall 41 has rearwadly protruding, concentric disc 53. Disc 53 is rotatably retained in the saddle formed by rearwardmost wall 15*b*. As illustrated, then, chamber 7 is rotatable about its central longitudinal axis merely by manually turning enlarged disc 47 clockwise or counterclockwise as desired.

Smoking stem 9 is located immediately to the rear of disc 53. This is conveniently accomplished by forming stem 9 of a large transversely cylindrical pivot joint 55 and a long tubular mouth piece 57. The smaller concentric ends 55*a* of pivot joint 55 then rotatably reside in the saddle formed in base walls 59, thereby allowing stem 9 to be rotated transversely to the longitudinal axis of chamber 7. Stem 9 is provided with an orifice 61. As illustrated best in FIG. 6, the end of pivot joint 55 is provided with a mating protrusion 63. In turn, exit orifice 45 is provided with a countersink 45*a* thereby to snuggly accommodate protrusion 63. By making walls 15*a* and 15*b* resilient, protrusion 63 can be located via the location of pivot 55 so as to slightly overlap with the rearwardmost end 65 of disc 53. When stem 9 is rotated so as to bring orifice 61 into alignment with orifice 45, protrusion 63 actually snaps into the countersink 45*a*, there to be held snuggly by the normal bias of the resilient walls 15*a* and 15*b*. Leakage of smoke at this junction is thereby minimized. In addition, the ability to rotate chamber 7 is greatly inhibited. When stem 9 is fully rotated in the other direction it comes to rest in compartment 27, thereby to be protected from being broken off when being carried or not otherwise in use.

Cap 5 is conveniently pivoted at the same pivot connection as stem 9. This is accomplished by pivot pins 67 concentrically extending from protrusions 55*a* and into the side walls of cap 5. Cap 5 extends, when closed, across the entire length of side wall 39 coming to rest concentrically on the upper portion of inner concentric disc 69 of front wall 37 and rear wall 41. Cap 5 may be snap fit with the side walls of base 3 (dotted lines at "B" in FIG. 3) thereby to form a tightly retained and sealed burning chamber 7. In this way the side walls of cap 5 form approximately the upper half of the semicylinder of the retaining compartment for burning chamber 7 while side walls 15 (at dotted line in FIG. 3) form the lower half.

Figure 6:
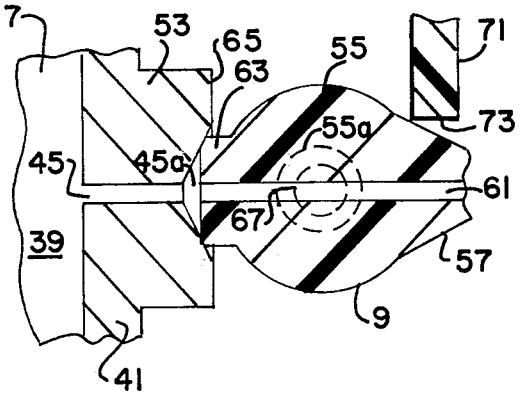
FIG. 6 is a partially sectionalized, partial view of the smoking mechanism of the embodiment of FIG. 1.

The rearward wall 71 of cap 5 wraps around and downwardly extends thereby to form a type of cavity to house pivot joint 55 and keep it clean. Rearward wall 71 terminates, however, in a lateral surface 73. This surface 73 serves as a limit stop on the ability to rotate stem 9. As illustrated in FIG. 6, abutting engagement also serves to insure that proper alignment of orifices 61 and 45 has been achieved. It is also to be noted that when this abutment exists, cap 5 cannot be rotated nor is rotation of chamber 7 easily achieved; and conversely, if cap 5 is other than closed, alignment of orifices 61 and 45 cannot be achieved because stem 9 cannot be rotated far enought to achieve this alignment. This is a distinct safety feature in that before a flame from lighter 23 can be drawn in to ignite the material in chamber 7, the cap 5 must be in its closed position, thus fully enclosing chamber 7 within compartment 13 during ignition and smoking. In addition chamber 7 cannot be inadvertently rotated, thereby preventing the accidental dumping of partially lit material into compartment 17.

OPERATION

Device 1 is simply and safely operated by first closing cap 5 and positioning chamber 7 in its "smoking" position. Thereafter bottom plate 11 is removed and compartment 17 is filled with smoking material. Bottom plate 11 is next replaced and disc 47 is rotated fully, clockwise, until "load" appears at the top of disc 47 and protrusion 50 resides in right hand groove 52. In this position chamber 7 is aligned in dispensing communication with compartment 17. Device 1 is tilted so that the smoking material in compartment 17 flows into and fills hollow chamber 7. Disc 47 is then rotated fully counterclockwise until "smoke" appears at the top of disc 47 and protrusion 50 resides in left hand groove 52. Device 1 is brought back to its upright position shown in the drawings and cap 5 is checked to be sure it is shut tightly.

Stem 9 is then rotated out of compartment 27 until it abuts lateral surface 73. In this position cap 5 can no longer be opened and orifice 45 is securely aligned with orifice 61. Lighter 23 is activated and its flame is drawn into chamber 7 by sucking action on mouth piece 57 which is continued until the smoking material is ignited. The flame is then extinguished and the smoking process is carried out to its desired extent without any substantial amount of smoke exiting other than via orifice 61.

When the smoking process is completed, stem 9 is rotated back into compartment 27 and cap 5 may be opened and chamber 7 cleaned with tools previously removed from compartments 29 or 31. The above-described process may then be repeated as described.

Once given the above disclosure, many other features, modifications and improvements will become apparent to the skilled artisan. Such other features, modifications and improvements are, therefore, considered a part of this invention, the scope of which is to be determined by the following claims:

I claim:

1. A smoking device comprising:

a base member having at least three compartments therein, said compartments including a first compartment for rotatably retaining a longitudinal burning chamber, a second compartment for retaining a material to be smoked, said second compartment being in dispensing communication with said first compartment, and a third compartment for retaining therein a means for providing a flame to said burning chamber;

a longitudinally extending, hollow burning chamber comprised of a side wall, a front wall and a rear wall, said side wall having located therein a loading orifice, said front wall having located therein a flame admitting orifice and said rear wall having located therein an exit orifice, said chamber being retained in said first compartment so as to be rotatable thereby to bring said loading orifice into and out of dispensing communication with said second compartment and further so as to locate said flame admitting orifice in proximal alignment with said third compartment;

a smoking stem rotatably attached to said base member, said stem being provided with a smoking orifice so located that upon rotation of said stem, said smoking orifice may be aligned or unaligned with said exit orifice; and means for opening or closing said loading orifice when said loading orifice is out of dispensing communication with said second compartment.

2. A smoking device according to claim 1 wherein said second compartment is provided with an eggress opening for filling said compartment with the material to be smoked, and said device further includes means for closing said eggress opening.

3. A smoking device according to claim 1 wherein said burning chamber is rotatable about its longitudinal axis and said loading orifice comprises an elongated opening extending longitudinally along substantially the entire length of said side wall.

4. A smoking device according to claim 3 wherein said flame admitting orifice and said exit orifice extend through said front and rear walls respectively along the central longitudinal axis of said burning chamber.

5. A smoking device according to claim 4 wherein said burning chamber is cylindrical in shape.

6. A smoking device according to claims 1, 2, 3, 4 or 5 wherein said means for opening or closing said loading orifice comprises a cap rotatably connected to said base, said cap being so constructed and located that when the smoking orifice of said smoking stem is aligned with said exit orifice said cap, if in its closed position, cannot be rotated to its open position.

7. A smoking device according to claim 6 wherein said cap extends over substantially the entire length of said side wall and rear wall of said burning chamber and is connected to a common rotatable pivot means with said smoking stem, said rotatable pivot means extending substantially transverse to the longitudinal axis of said burning chamber.

8. A smoking device according to claim 7 wherein said smoking stem includes a transverse pivot joint and a relatively thin elongated mouth piece extending from said pivot joint, said cap extending over and around a substantial portion of said pivot joint and said common transverse pivot means and having a stop opening therein through which said elongated mouth piece may extend, said stop opening having an upper edge means for abutting said mouth piece when said smoking orifice is in alignment with said exit orifice thereby preventing further rotation of said smoking stem, said stop opening being positioned with respect to said common pivot means such that said cap when in closed position cannot be rotated when said smoking stem abuts said upper edge means, and said burning chamber is inhibited from rotating.

9. A smoking device according to claim 8 which further includes means for preventing the rotation of said burning chamber beyond its loading or smoking position and for indicating when said chamber is in its loading or smoking position.

10. A smoking device according to claim 1 which further includes means for preventing the rotation of said burning chamber beyond its loading or smoking position and for indicating when said chamber is in its loading or smoking position.

11. A smoking device according to claim 10 wherein said preventing and indicating means includes a flange attached to said base member, said flange having an edge located adjacent the front wall of said burning chamber on either side of the longitudinal axis of said burning chamber, said front wall having extending therefrom a protrusion so located with respect to said flanges so as to abut one of said flanges when said burning chamber is in its smoking position and abut the other of said flanges when said burning chamber is in its loading position.

12. A smoking device according to claim 11 which further includes means for indicating which flange to protrusion abuttment is the smoking position and which is the loading position.

* * * * *